United States Patent [19]

Hunter

[11] 4,026,471

[45] May 31, 1977

[54] SPRINKLER SYSTEMS

[75] Inventor: Edwin J. Hunter, Rancho Santa Fe, Calif.

[73] Assignee: The Toro Company, San Marcos, Calif.

[22] Filed: Apr. 1, 1976

[21] Appl. No.: 672,661

[52] U.S. Cl. ..... 239/206; 239/240

[51] Int. Cl.[2] ..... B05B 15/10; B05B 3/04

[58] Field of Search ..... 239/203–206, 239/237, 240, 241, 242, 230, 262

[56] References Cited

UNITED STATES PATENTS

| | | | |
|---|---|---|---|
| 1,742,898 | 1/1930 | Buelna | 239/230 |
| 3,117,724 | 1/1964 | Ray | 239/204 X |
| 3,266,730 | 8/1966 | Martini | 239/205 |
| 3,383,047 | 5/1968 | Hauser | 239/206 |
| 3,854,664 | 12/1974 | Hunter | 239/206 |
| 3,948,285 | 4/1976 | Flynn | 239/230 X |

*Primary Examiner*—Johnny D. Cherry
*Assistant Examiner*—Andres Kashnikow
*Attorney, Agent, or Firm*—Poms, Smith, Lande & Glenny

[57] ABSTRACT

Improvements in sprinkler systems having fluid under pressure flowing therethrough and a sprinkler head with a pop-up nozzle actuated by fluid pressure. An impeller is actuated by the fluid flow to rotate the nozzle and thus rotate the spray of fluid threfrom. A transmission is disposed between the impeller and the nozzle for transmitting rotation of the impeller to the nozzle. Means are provided for regulating the rate of rotation of the impeller, and then the nozzle, under varying volume flow of fluid being sprayed thereout. This may be accomplished by a substantially constant velocity of incoming fluid impinging on impeller blades. This velocity may be maintained substantially constant by a variable resistance valve in association with a stationary stator having blades thereon which valve moves with respect to the stator to provide a guided substantially constant velocity of jets of fluid on the impeller blades to rotate the same which in turn rotates the nozzle at a substantially constant rate of rotation.

22 Claims, 7 Drawing Figures

SPRINKLER SYSTEMS

BACKGROUND OF THE INVENTION

1. Field of the Invention

The invention relates to sprinkler systems, and more particularly, to improvements in sprinklers used in such systems wherein water under pressure causes the sprinkler head and nozzle thereof to pop up to disperse or spray water out of the nozzle.

2. Description of the Prior Art

In my U.S. Pat. No. 3,584,664, I disclosed an improved sprinkler system wherein fluid under pressure flows through a sprinkler and a sprinkler head and nozzle, actuated by the fluid pressure, pops up and sprays water out of the nozzle. Such sprinklers include an impeller actuated by fluid flow and a transmission which converts rotation of the impeller to rotation of the nozzle.

In such sprinklers, suitable means may be provided for varying the pattern of the sprayed fluids. For example, differing types of nozzles may be substituted on the sprinkler. Such means may also take the form of plates or patterns of varying types which can be substituted in the sprinkler for varying the spray of fluid thereout.

It can be appreciated that a wide variety of water flow or volume of water being sprayed out of the nozzle may be obtained in this manner, such as from about ½ to 20 gallons of water per minute. During these differing volumes of water spray, it is desired that the nozzle rotate at a predetermined rate. For example, it is preferable that the rate of rotation of the nozzle be neither too slow or too fast. Preferably, a rate of rotation of about one to three minutes for each revolution of the nozzle would be desirable.

However, if the range of water volume spray provided by varying either the nozzle itself or changing the pattern of spray of the nozzle is so great that, in such prior art sprinklers, the nozzle will rotate either too fast or too slow. Accordingly, it is necessary that such sprinklers have means for compensating for differing volumes of water spray out of the nozzles and automatically adjusting the rate of rotation of such nozzles depending on the volume of water spray.

SUMMARY OF THE INVENTION

It is an object of this invention to provide an improved means for dispersing fluid under pressure out of the rotating nozzle of a sprinkler system.

It is a further object of this invention to provide a means for regulating the rate of rotation of the nozzle of the sprinkler head in such sprinkler system regardless of the volume of fluid being sprayed out of the nozzle.

It is still another object of this invention to automatically compensate for the pressure drop taking place in such a sprinkler system when the volume of fluid being sprayed out of the rotating nozzle thereof is varied.

It is a still further object of this invention to carry out the foregoing object in a manner controlling the rate of rotation of the nozzle.

These and other objects are preferably accomplished by providing improvemets in a sprinkler system having fluid under pressure flowing therethrough and a sprinkler head with a pop up nozzle actuated by fluid pressure. An impeller is actuated by the fluid flow to rotate the nozzle and thus rotate the spray of fluid therefrom. A transmission is disposed between the impeller and the nozzle for transmitting rotation of the impeller to the nozzle. The improvements include means for regulating the rate of rotation of the nozzle regardless of the volume of fluid being sprayed thereout. This may be accomplished by a substantially constant velocity of incoming fluid impinging on impeller blades. This velocity may be maintained substantially constant by a variable resistance valve in association with a stationary stator having blades thereon which valve moves with respect to the stator to provide a guided substantially constant velocity of jets of fluid on the impeller blades to rotate the same which in turn rotates the nozzle at a substantially constant rate of rotation.

DESCRIPTION OF THE PREFERRED EMBODIMENT

Figure 1:
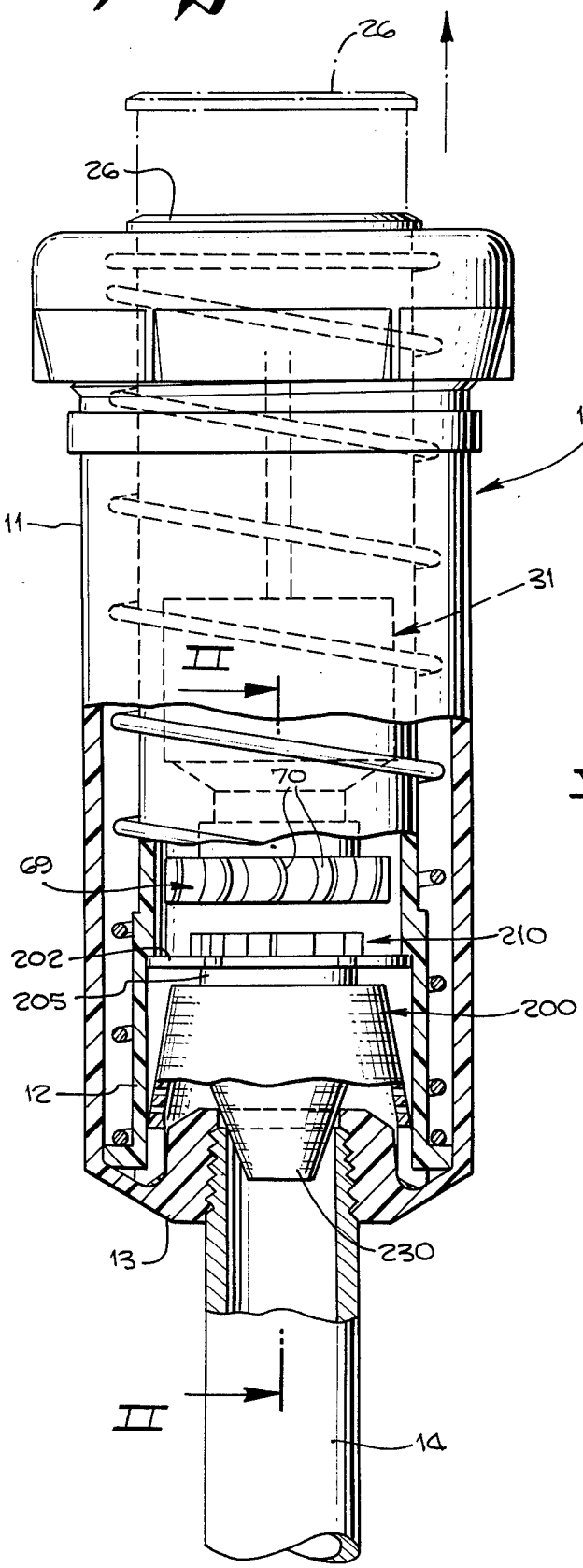
FIG. 1 is an elevation view, partly in section, of a conventional sprinkler having an improvement thereon in accordance with the teachings of my invention.

Referring to FIG. 1 of the drawings a sprinkler head 10 is shown essentially similar to that described in U.S. Pat. No. 3,854,664, the teachings of which are incorporated herein by reference. Such a sprinkler head 10 includes an outer housing 11 and an inner housing 12. Housing 11 terminates at its lower end in a water inlet 13 with a water supply line 14 threaded therein all as disclosed in the aforementioned patent. Head 10 further includes a pop-up nozzle 26 which is adapted to pop up out of head 10 and spray water thereout as is taught by U.S. Pat. No. 3,853,664. In Column 9, lines 20 through 40, of that patent, it is disclosed how the pattern of spray out of nozzle 26 may be varied. Varying the size of the openings in the nozzle 26 would of course vary the quantity of water being sprayed. For example, such nozzles may be varied to spray water thereout in a range of about ½ to 20 gallons per minute using different nozzles on the sprinkler head. Further, such nozzle 26 is disclosed in U.S. Pat. No. 3,854,664 as rotating while spraying. It is desirable that the rate of rotation of such nozzles be kept within an optimum rate of rotation regardless of the volume of fluid being sprayed thereout, as for example, one every one to three minutes.

Sprinkler head 10, in U.S. Pat. No. 3,854,664, also includes means for impelling fluids entering line 14 in the form of an impeller or rotor 69 having a plurality of impeller blades 70 spaced thereabout, the planes of blades 70 preferably being angled or inclined from the vertical or curved to assist in the impelling of fluids striking such blades 70. Rotor 69 also may include, as in U.S. Pat. No. 3,854,664, a generally centrally located apertured boss or the like for receiving a pin (not shown) in tight-fitting relationship. This pin couples rotor 69 to transmission means 31, shown in dotted lines, which transmission means 31 is coupled to nozzle 26. Reference should be made to U.S. Pat. No. 3,854,664 for a complete understanding of the operation of the impeller or rotor 69, pin 72 and the transmission means 31 and the nozzle 26.

As particularly contemplated in the present invention, and as discussed hereinabove, nozzle rotation control means 200 (see particularly FIG. 2) are provided for rotating nozzle 26 at a substantially constant rate of rotation regardless of the flow rate of fluid being dispersed out of nozzle 26. In the exemplary embodiment of the invention, such nozzle rotation control means 200 may include valve means 201 movable in a support member 202 which comprises a generally circular disk pressfit or the like into the lower end of inner housing 12 directely below impeller 69. Of course, instead of a disk, member 202 may conform generally to the inner configuration of housing 12. Alternatively, other means may be provided for positioning member 202 in housing 12 in a generally fluid-tight manner.

Figure 5:
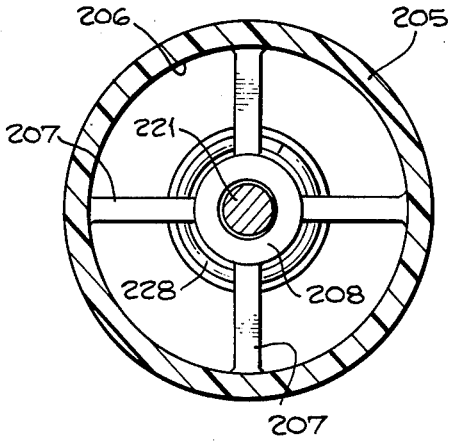
FIG. 5 is a sectional view taken along lines V—V of FIG. 2.

Member 202 preferably includes a generally circular opening 204 with an integral boss 205 having a throughbore 206 for receiving the valve means 201 therein. As can be seen more particularly in FIG. 5, cross-flanges 207 extend across throughbore 206 (and thus transverse opening 204) for supporting a generally circular ring member 208 at generally the midpoint of throughbore 206 (and thus generally coincident with the center of opening 204). Ring member 208 includes an extension portion 209 extending away from opening 204 and generally coaxial therewith.

Figure 6:
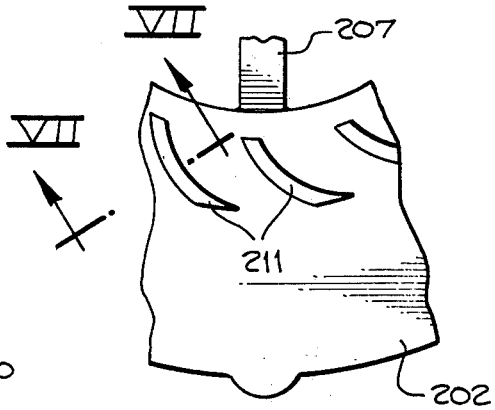
FIG. 6 is a detailed view of a portion of the apparatus of FIG. 2.
Figure 7:
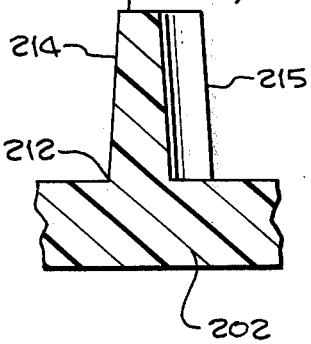
FIG. 7 is a sectional view taken along lines VII—VII of FIG. 6.
Figure 3:
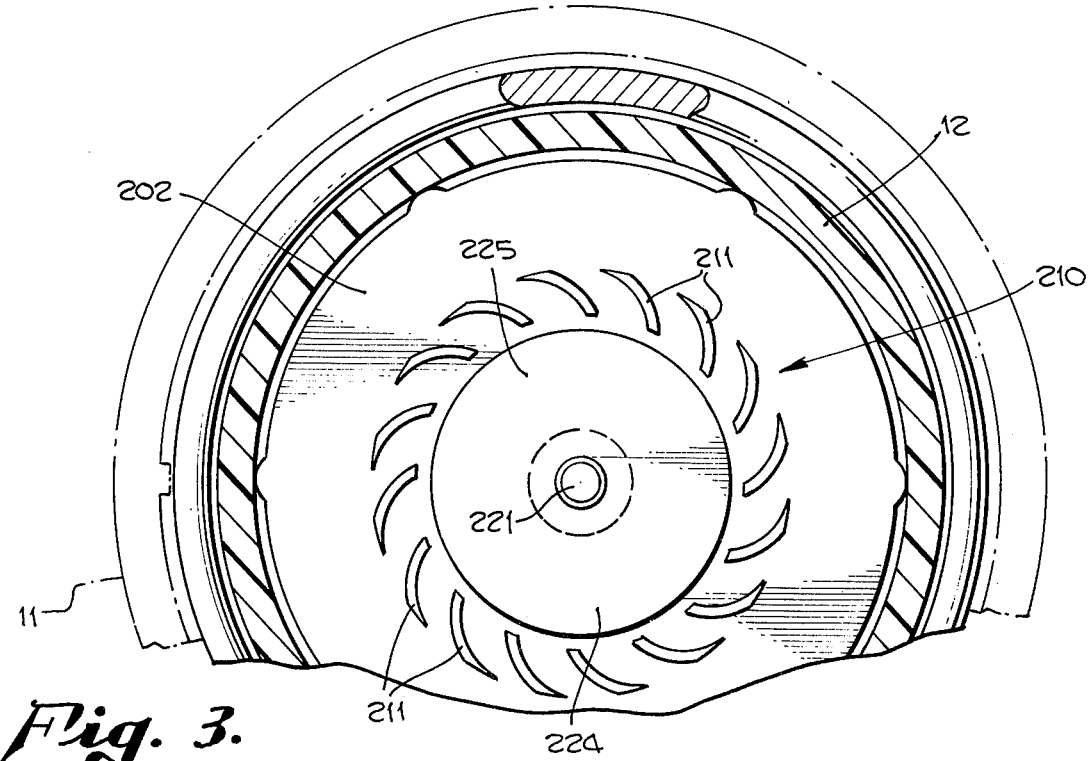
FIG. 3 is a view, partly in section, taken along lines III—III of FIG. 2.

Before discussing valve means 201, as particularly contemplated in the present invention, fluid directing means 210, are provided on support member 202 on the side thereof adjacent impeller 69 for directing fluid flowing through opening 204 against blades 70 of impeller 69. In the exemplary embodiment of the invention, such fluid directing means 210 preferably includes a plurality of spaced radially extending blades 211 (see particularly FIG. 3) on support member 202 surrounding opening 204. Blades 211 are curved outwardly from the center of the opening 204 having a curvature opposite the curvature or inclination of impeller blades 70. As shown in FIGS. 3 and 6, each successive blade 211 has a progressively increasing radius of curvature, as for example, from about 0.171 inches to about 0.187 inches. As shown in FIG. 7, each blade 211 may taper from its base 212 to its top 213 from the bottom upwardly, as for example, sides 214, 215 each being at an angle from the vertical of about 3°.

Figure 2:
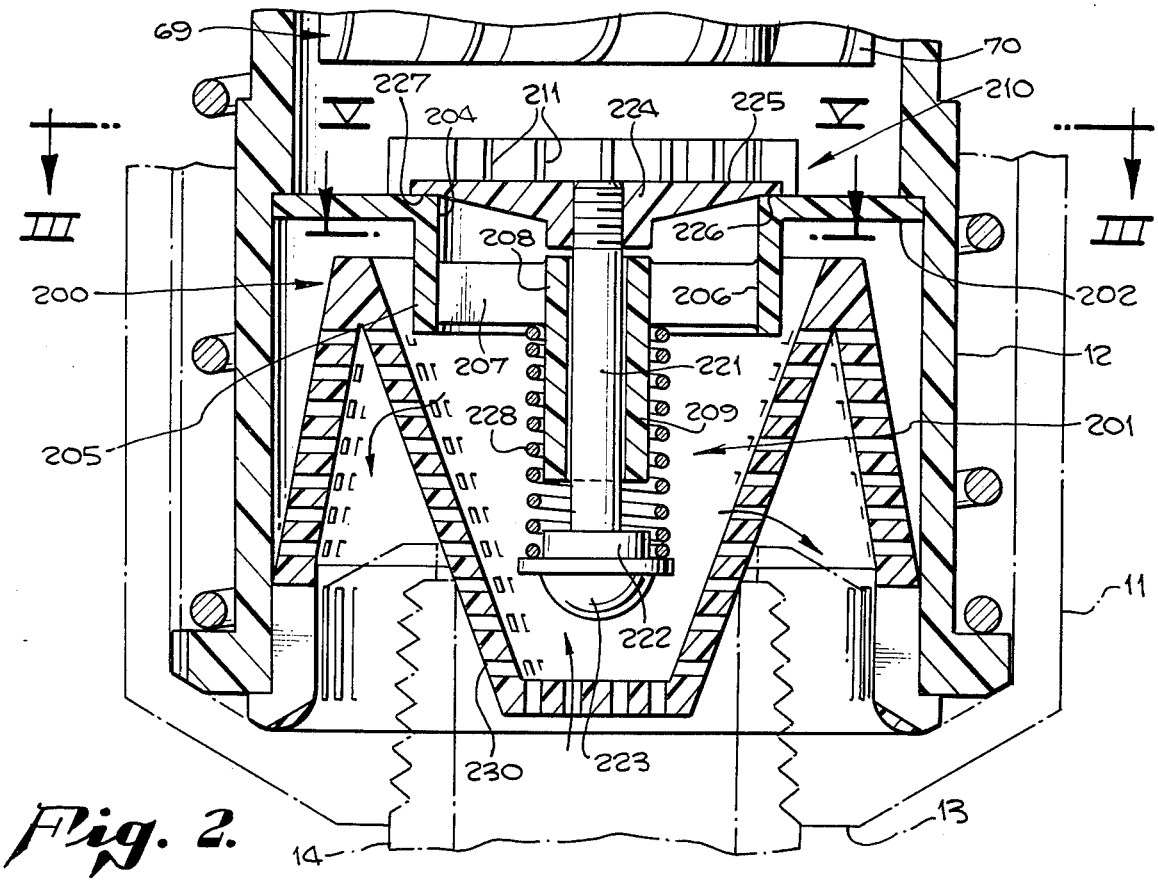
FIG. 2 is a detailed, partly cross-sectional, view of the portion of the sprinkler of FIG. 1 improved in accordance with the teachings of my invention, taken along lines II—II of FIG. 1.
Figure 4:
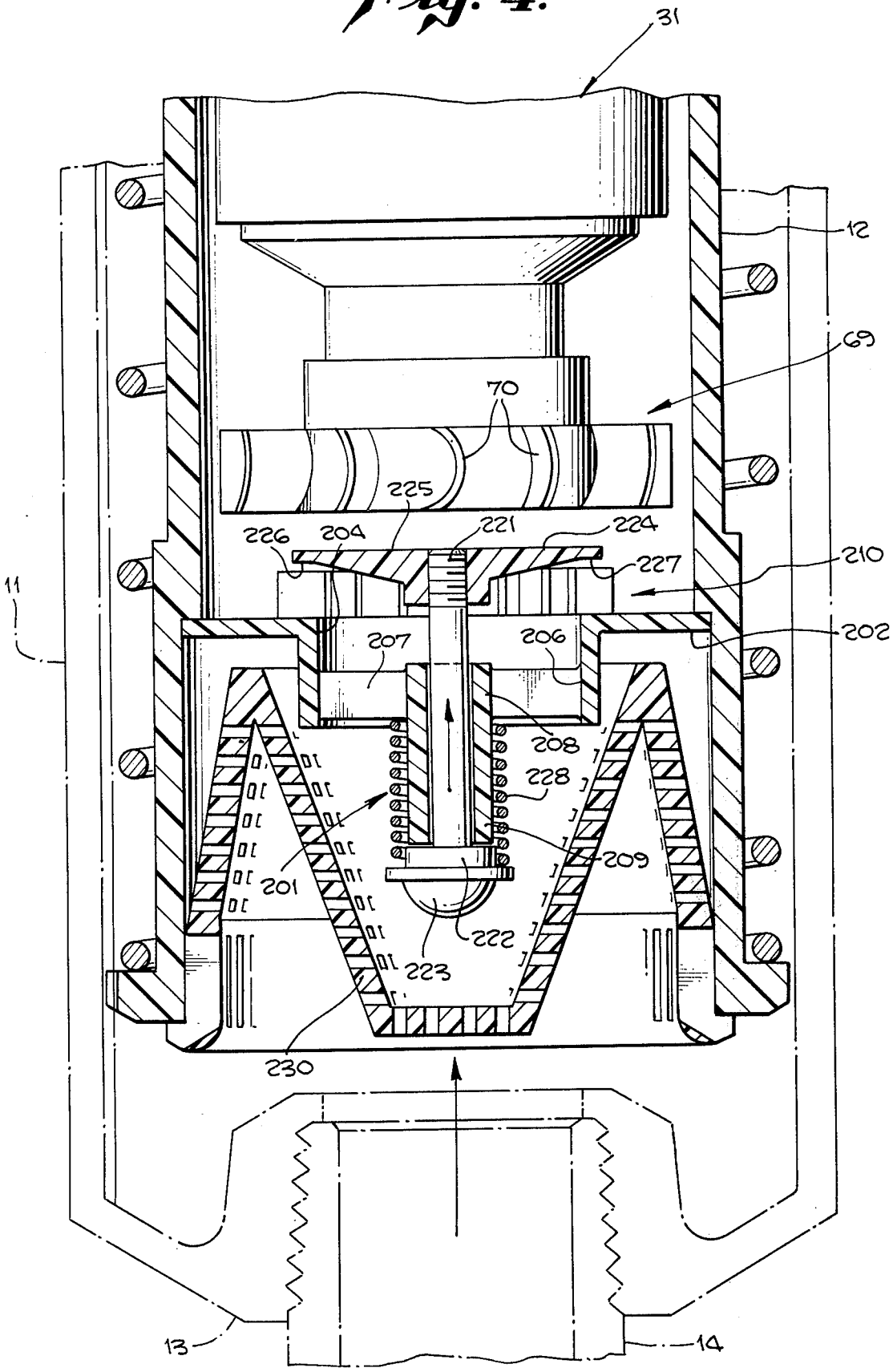
FIG. 4 is a sectional view similar to FIG. 2 illustrating the movement of various components thereof.

Referring again to FIG. 2, as particularly contemplated in the present invention, nozzle rotation control means 200 further includes variable resistance valve means 201 for controlling the flow rate of fluid through opening 204, past fluid directing means 210 and against impeller blades 70. In the exemplary embodiment of the invention, such valve means 201 includes a valve stem 221 movable within extension portion 209 terminating at one end in an enlarged stem portion 222 of an outer diameter substantially the same as the outer diameter of extension portion 209. A cap or step member 223 is provided at the outer end of stem portion 222 of a diameter slightly greater than stem portion 222 for providing limiting means for limiting movement of valve stem 221 upwardly in FIG. 2 when stem portion 222 abuts against extension portion 209. As can be seen in FIG. 2, this limits the movement of valve member 224, (as shown in FIG. 4), to generally the plane of the upper surface of blades 221. The other end of valve stem 221 terminates in valve member 224. Valve member 224 preferably has generally flat upper and lower surfaces 225, 226 (FIG. 2) and is preferably the same configuration as opening 204. That is, if opening 204 is generally circular, as in the peferred embodiment, valve member 225 is also generally circular. Also, valve member 224 is of a slightly greater diameter than opening 204 to provide a fluid-tight fit, as will be discussed. The peripheral edge 227 of member 224 may be square-shaped, as shown in FIGS. 2 and 4, to provide both a fluid-tight fit and controllable cracking area when valve member 224 is moved away from opening 204. The peripheral edge of opening 204 may also be square-shaped, as shown. This directs the flow of water radially into blades 70.

Biasing means 228 in the preferred form of a coil spring surrounding extension portion 209, valve stem 221 and stem portion 222, retained thereon between stop member 223 and cross-flanges 207 of boss 205, is provided for normally biasing valve member 224 against opening 204 in a fluid-tight relationship. The resiliency of coil spring 228 may be selected to move valve member 224 at a preset or predetermined pressure drop when fluid is flowing out of nozzle 26, such as about 3 psi.

Finally, a screen member 230 may be disposed between water inlet 13 and control means 200 for filtering out any impurities in the fluid entering inlet 13. As shown in FIG. 2, screen member 230 may be configured to receive the components of control means 200 therein so as to surround the lower end thereof.

In operation, when fluid enters sprinkler head 10 through line 14 and nozzle 26 pops up out of head 10 and begins to rotate, as taught in U.S. Pat. No. 3,854,664, the force of fluid entering throughbore 206 and opening 204 will act on valve member 224 and against the bias of spring 228 causing valve member 224 to open as shown in FIG. 4. The fluid will be directed by blades 211 against impeller blades 70 which rotates impeller 69 and, via transmission means 31, in turn rotates nozzle 26. When the amount of fluid exiting out of nozzle 26 is varied, as for example, by providing a nozzle having different openings therein on head 10, as taught in U.S. Pat. No. 3,854,664, a pressure drop will take place at valving means 220. Spring 228 automatically compensates for this change in pressure drop varying the position of valve member 224 with respect to the extent of cracking area opened in opening 204.

Thus, control means 200 compensates for the relatively wide vatiation of water volume that might take place in using nozzles having different rates of flow of fluid thereout. Regardless of such rate of flow, valve means 201 rotates nozzle 26 at a relatively constant rate of speed, e.g., one to three minutes per one complete revolution. Valve means 201 regulates the pressure drop of fluid as it enters sprinkler head 10 past valve member 224 and against impeller 29. The biasing means 228 and the valve components are chosen to give a predetermined or preset pressure drop through valve means 201 regardless of the rate of fluid out of nozzle 26.

I claim as my invention:

1. In a sprinkler having a head mounting a nozzle for dispersing fluid through said head and out of said nozzle and impeller means associated with said head operatively engaging said nozzle for rotating said nozzle in response to said fluid passing through said head, said impeller means including transmission means for transmitting movement of said impeller means to said nozzle, the improvement which comprises:

nozzle rotation control means associated with said impeller means for rotating said nozzle at a substantially constant rate of rotation regardless of the flow rate of fluid being dispersed out of said nozzle, said nozzle rotation control means including fluid directing means for directing fluid flow to said impeller means, and valve means for varying the flow rate of fluid through said fluid directing means to maintain a substantially constant velocity flow rate for changing volume flow rates of fluid flowing to said impeller means.

2. In the sprinkler of claim 1 wherein said impeller means includes an impeller having a plurality of spaced impeller blades and said nozzle rotation control means includes a support member mounted in said sprinkler downstream of said impeller means having an opening therein generally coaxially aligned with said impeller means, said fluid directing means being on said support member between said opening and said impeller means for directing fluid flowing through said sprinkler past said opening and against said impeller blades, and said valve means operating with said opening for controlling the flow rate of fluid through said opening, past said fluid directing means and against said impeller blades.

3. In the sprinkler of claim 2 wherein said fluid directing means includes a plurality of spaced radially extending blades on said support member surrounding said opening.

4. In the sprinkler of claim 3 wherein said impeller blades are curved outwardly away from the center of said impeller and said blades on said support member are curved outwardly from the center of said opening having a curvature opposite the curvature of said impeller blades.

5. In the sprinkler of claim 4 wherein each successive ones of said blades on said support member have a progressively increasing radius of curvature.

6. In the sprinkler of claim 5 wherein said radius of curvature of said blades on said support member increases from about 0.171 inches to about 0.187 inches.

7. In the sprinkler of claim 5 wherein each of said blades on said support member is generally trapezoidal in vertical cross-section having a base portion tapering inwardly and upwardly to a top portion.

8. In the sprinkler of claim 7 wherein each of said blades on said support member tapers at an angle from the vertical of about 3°.

9. In the sprinkler of claim 2 wherein said valve means includes a valve stem generally centrally mounted in said opening extending through said opening away from said impeller means, biasing means associated with said valve stem for biasing the valve stem in a direction away from said impeller means, and a valve member fixed to said stem having an outer configuration substantially the same as and slightly greater than the configuration of said opening and disposed on the same side of said opening as said fluid directing means, said biasing means biasing said valve member against said opening in a manner substantially sealing off the flow of fluid therepast.

10. In the sprinkler of claim 9 including limiting means associated with both said valve stem and said support member for limiting the movement of said valve member away from said opening.

11. In the sprinkler of claim 9 wherein said opening is generally circular and said valve member is a generally circular disc slightly greater in diameter than the diameter of said opening.

12. In the sprinker of claim 10 wherein the peripheral edge of said circular disc is generally square-shaped.

13. In the sprinkler of claim 9 wherein said biasing means is preset to move said valve member away from said opening and toward said impeller means at a predetermined drop in pressure of fluid flowing out of said nozzle.

14. In the sprinkler of claim 13 wherein said biasing means is preset to move said valve member at a pressure drop of about 3 psi.

15. In the sprinkler of claim 9 wherein said opening includes a boss extending from said support member about said opening having a throughbore therein and a plurality of cross-flanges extending across said throughbore and an extension portion also having a throughbore fixed to said flanges extending in a direction away from said impeller means, said throughbores being substantially coicident with the central axis of said opening, said valve stem being comprised of a main stem portion extending through said throughbores with generally the middle of said valve member fixedly secured to one end of said main stem portion and said main stem portion terminating at its other end in an enlarged portion, and said biasing means includes a coil spring surrounding both said extension portion of said main stem portion between said enlarged portion and said flanges.

16. In the sprinkler of claim 15 wherein said main stem portion includes a first body portion of an outer diameter slightly less than the inner diameter of said throughbore in said extension portion and slidable therein, and a second body portion integral with said first body portion and said enlarged portion between said first body portion and said enlarged portion having an outer diameter greater than the outer diameter of said first body portion and less than the outer diameter of said enlarged portion and substantially the same as the outer diameter of said extension portion so that said second body portion abuts against said extension portion when said biasing means moves said valve member away from said opening to thereby limit the extent of movement of said valve member.

17. In a sprinkler having a head mounting a nozzle for dispersing fluid through said head and out of said nozzle and impeller means associated with said head operatively engaging said nozzle for rotating said nozzle in response to said fluid passing through said head, said impeller means including transmission means for transmitting movement of said impeller means to said nozzle, the improvement which comprises:

a support member mounted in said sprinkler downstream of said impeller means having a main body portion, a generally circular opening therethrough, and a plurality of spaced radially extending stator blades extending about said opening on the side of said main body portion adjacent said impeller means;

a valve movable in said opening having a valve stem extending in a direction along generally the central axis of said opening on the side thereof opposite said impeller means and a valve member conformably fitting in said opening fixed to said stem, and valve member being disposed on the side of said opening adjacent said impeller means; and biasing means associated with both said valve and said support member for normally biasing said valve member against said opening.

18. In the sprinkler of claim 17 wherein said biasing means includes means associated therewith for varying the extent of movement of said valve member away from said opening toward said impeller means when a predetermined pressure drop takes place in said sprinkler.

19. In a sprinkler having a head mounting a nozzle for dispersing fluid through said head and out of said nozzle and impeller means associated with said head operatively engaging said nozzle for rotating said nozzle in response to said fluid passing through said head, said impeller means having impeller blades upon which fluid entering said head impinges thereon to rotate the same and including transmission means for transmitting movement of said impeller means to said nozzle, the improvement which comprises:

variable resistance valve means associated with a stationary stator mounted in said head, said valve means being movable with respect to said stator when incoming fluid impinges on said valve means to thereby move said valve means to maintain a substantially constant velocity flow rate of jets of fluid on said impeller blades to rotate the same at a substantially constant rate of rotation to thereby rotate said nozzle at a substantially constant rate of rotation regardless of the flow rate of fluid dispersed out of said nozzle.

20. In the improvement in the sprinkler of claim 19 wherein said valve means includes biasing means biasing said valve means away from said stator toward said impeller means, said biasing means being adapted to vary the extent of movement of said valve means toward said stator dependent upon the pressure drop of incoming fluid on said valve means.

21. In the improvement in the sprinkler of claim 19 wherein said stator includes a plurality of spaced stator blades thereon aligned with said impeller blades on the side of said stator adjacent said impeller blades, said variable resistance valve means being movable away from said stator a distance sufficient to permit incoming fluid to flow past said valve means said stator and into contact with said stator blades, said stator blades guiding said incoming fluids against said impeller blades.

22. In the improvement in the sprinkler of claim 19 including limiting means associated with said valve means for limiting the extent of movement of said valve means away from said stator toward said impeller means.

* * * * *